US006904849B2

(12) United States Patent
Abe

(10) Patent No.: US 6,904,849 B2
(45) Date of Patent: Jun. 14, 2005

(54) WASTE INCINERATING METHOD AND DEVICE FOR THE METHOD

(76) Inventor: Toshihiro Abe, A, Sakamoto-jutaku, 17-10-1, Shimonitanai, Hanamaki-shi, Iwate 025-0006 (JP)

( * ) Notice: Subject to any disclaimer, the term of this patent is extended or adjusted under 35 U.S.C. 154(b) by 0 days.

(21) Appl. No.: 10/250,485

(22) PCT Filed: Jan. 9, 2001

(86) PCT No.: PCT/JP01/00046

§ 371 (c)(1),
(2), (4) Date: Jul. 3, 2003

(87) PCT Pub. No.: WO02/055932

PCT Pub. Date: Jul. 18, 2002

(65) Prior Publication Data

US 2004/0060489 A1 Apr. 1, 2004

(51) Int. Cl.[7] ..... F23G 5/02
(52) U.S. Cl. ..... 110/219; 110/190; 110/250
(58) Field of Search ..... 110/219, 224, 110/225, 227, 228, 210, 211, 214, 345, 346, 190, 250

(56) References Cited

U.S. PATENT DOCUMENTS 4,257,494 A * 3/1981 Frankel ..... 187/373
5,280,757 A * 1/1994 Carter et al. ..... 110/346
5,315,938 A * 5/1994 Freller ..... 110/233
5,636,598 A * 6/1997 Moore, Jr. ..... 122/18.3
5,678,494 A * 10/1997 Ulrich ..... 110/224

FOREIGN PATENT DOCUMENTS

| | | |
|---|---|---|
| JP | 46-17351 | 6/1971 |
| JP | 52-111282 | 9/1977 |
| JP | 10-253029 | 9/1998 |
| JP | 11-159718 | 6/1999 |
| JP | 2000-193217 | 7/2000 |

OTHER PUBLICATIONS

Microfilm of the specification and drawings annexed to the request of Japanese Utility Model Application No. 6352/1972 (Laid–open No. 84369/1973), Hideharu Baba, Oct., 1973.

* cited by examiner

*Primary Examiner*—Kenneth Rinehart
(74) *Attorney, Agent, or Firm*—Wenderoth, Lind & Ponack, L.L.P.

(57) ABSTRACT

The present invention is a waste incinerating method and a device for the method, characterized in that, using a combustion furnace (111) incorporating a high temperature resistant coil-shaped flue (117) and having flue heating means and a thermo sensor (128), while maintaining the temperature inside the flue at a high temperature by suppressing an air feed amount and a temperature of the heating means, exhaust smoke produced by the combustion of waste is passed through the flue for complete combustion to completely eliminate the exhaust smoke. Because any harmful substance such as dioxin is not exhausted, the method and device are suitable as the incinerating method and incinerating device for inflammable waste.

6 Claims, 2 Drawing Sheets

WASTE INCINERATING METHOD AND DEVICE FOR THE METHOD

TECHNICAL FIELD

The present invention relates to a novel waste incinerating method that enables suppressing the exhaustion of harmful substances such as dioxin by imparting contrivance to the structure of a flue and processing the exhaust smoke at a high temperature, and a waste incinerating device using that method.

BACKGROUND ART

Until nowadays, as a device for incinerating waste, representatively, there is known the one that has a structure the section of which is illustrated in FIG. 2.

In this FIG. 2, a combustible waste that has been supplied from waste throw-in ports 5, 5' into a combustion chamber 2 of a combustion furnace 1 is mixed with an air fed from an air take-in port 11 to be burned and the combustion ash that has generated is passed through a hem portion 4 of a hood 3 and is accumulated on the bottom portion of the combustion furnace to be taken out from discharging doors 6, 6'.

On the other hand, the exhaust smoke that has occurred due to the combustion, passing through a large number of windows 7, . . . formed in the hood 3, is fed into a heating chamber 8 and is heated there by means of a burner 9. After being burned, the exhaust smoke passes through a chimney member 10. Then, after being cooled by a cooling pipe 12, the exhaust smoke is discharged to outside the device due to the action of an exhaust fan 13.

However, in the above-described method, inevitably, the combustion temperature fluctuates due to the kind of a relevant waste, the water portion contained therein, and the combustion conditions. As a result, it is impossible to make complete combustion of the exhaust smoke and make it smokeless. Also, for completely thermally decomposing the dioxin that is posing a social problem as the harmful substance, using a high temperature of 1400° C. or more is needed. However, in the method like that, it is difficult to obtain such a high temperature and, therefore, it was impossible to prevent the environmental pollution resulting from the exhaust smoke containing therein dioxin.

DISCLOSURE OF THE INVENTION

The present invention has been made under the above-described existing circumstances and an object of the present invention is to provide a novel waste incinerating method which, when performing combustion of a combustible waste, enables making smokeless the exhaust smoke that occurs and thereby enables suppressing the environmental pollution, and an incinerating device for executing that method.

The inventor of this patent application has made his intensive studies of the matter in order to develop a method enabling highly efficient combustion of the waste to be made and in addition not accompanied by harmful exhaust smoke. As a result, he has come to have an idea of desiccating relevant waste by utilizing a combustion heat and thereafter-burn it, and passing the exhaust smoke that occurs through a flue formed with an elongate pipeline, and heating this exhaust smoke within the passageway to a high temperature of 1400° C. or more to thereby perform complete combustion of it. By doing so, he has discovered that that exhaust smoke can be made the one not containing therein harmful substances such as dioxin and the like and, on the basis of that knowledge, has come to achieve the present invention.

Namely, the present invention provides a waste incinerating method characterized by including the steps of, when incinerating a waste, using a combustion furnace containing therein a high-temperature resistant coil-shaped flue and having equipped thereto heating means for heating the flue and a thermo sensor, controlling a supplying amount of air and the temperature of the heating means to thereby maintain the temperature of the interior of the flue at a value that falls within the range of from 1400 to 1600° C., burning the waste while the temperature is being maintained at that value, passing an exhaust smoke, which generates due to the combustion of that waste, through the flue for complete combustion, and making the exhaust smoke smokeless. The present invention also provides a waste incinerating device characterized by including:

(a) a combustion furnace main body that consists of a heat-resistant cylindrical member the upper part and lower part of which are each shaped like a truncated cone, the upper part being defined as a desiccation chamber and the lower part being defined as being a combustion chamber;

(b) a chimney member that is disposed within the combustion furnace in the way of its being open with respect to a bottom portion thereof and a top portion thereof and that consists of a high temperature resistant material-made coil-shaped pipe;

(c) a heater that is equipped to the chimney member for raising the temperature of the interior of said chimney member;

(d) a thermo sensor for measuring the temperature within said chimney member; and (e) control means for adjusting the amount of air supplied into the combustion furnace and the temperature of the heater according to the temperature information from said thermo sensor.

BEST MODE FOR CARRYING OUT THE INVENTION

Next, the present invention will be explained in detail with reference to the accompanying drawings.

Figure 1:
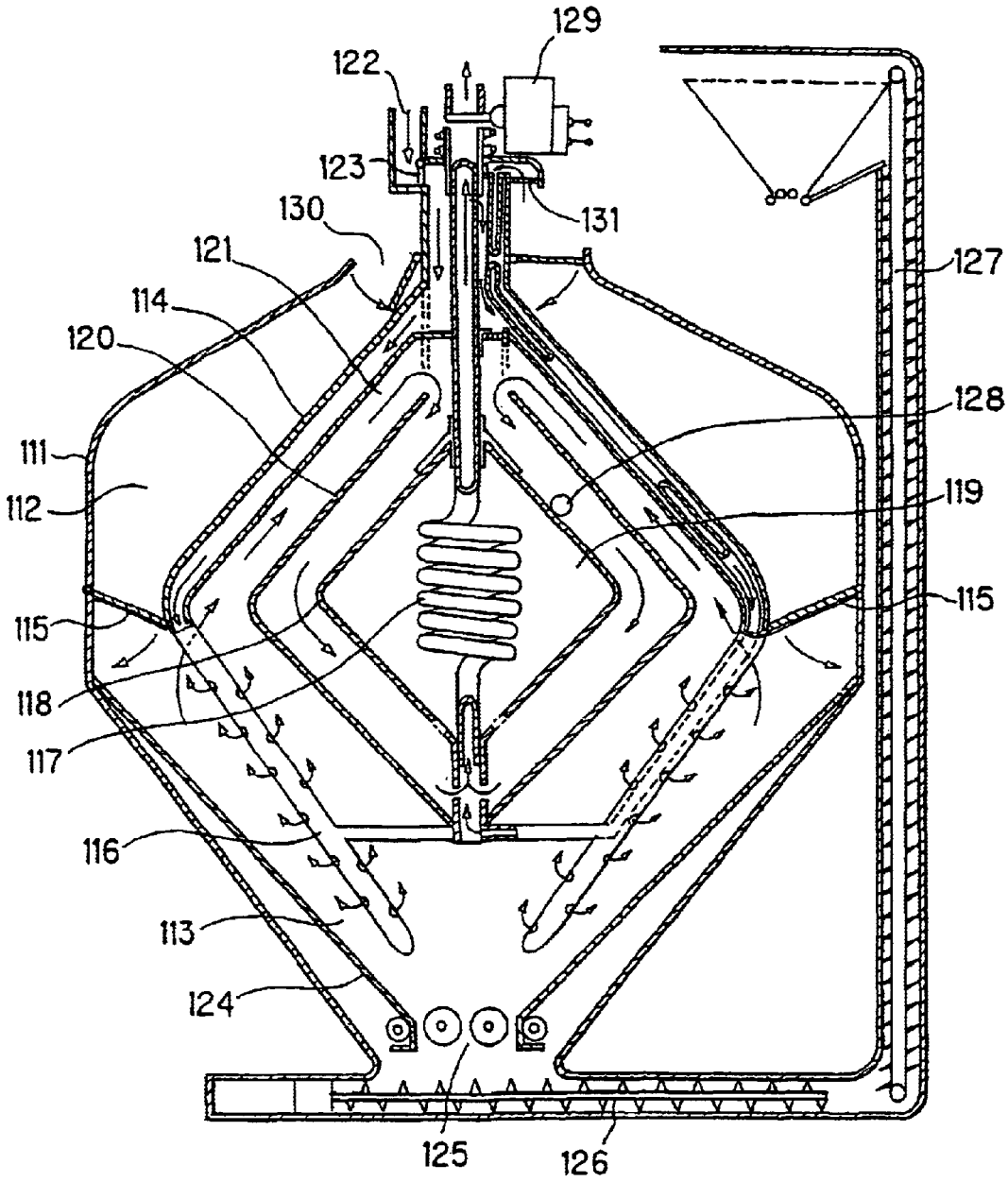
FIG. 1 is a sectional view illustrating an example of a structure of a waste incinerating device according to the present invention.
Figure 2:
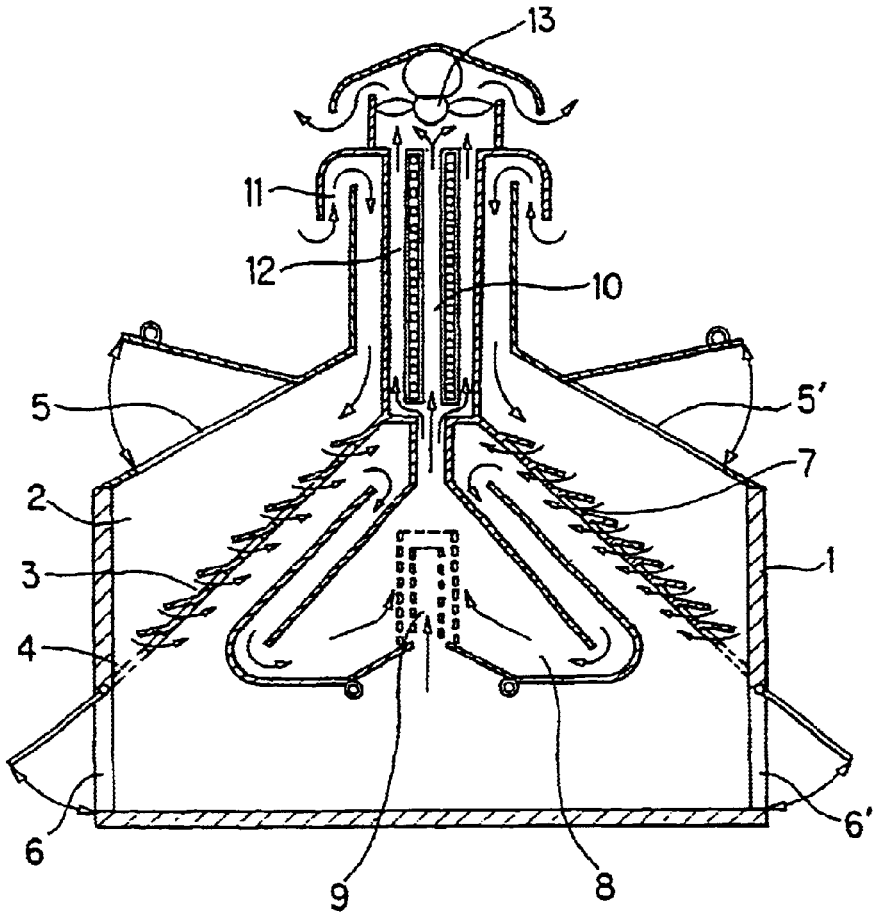
FIG. 2 is a sectional view illustrating an example of a structure of a conventional waste incinerating device.

FIG. 1 is a sectional view illustrating an example of a structure of a waste incinerating device according to the present invention. This device is constructed mainly of a combustion furnace main body 111 that consists of a heat-resistant cylindrical member the upper part and lower part of which are each formed into a truncated cone-like and a flue 117 that consists of coil-shaped pipe and that is contained in that main body 111.

And, said combustion furnace main body 111 is divided, by a smoke collection hood 114, into a desiccation chamber 112 including an upper truncated-conical portion and a combustion chamber 113 including a lower inverse truncated-conical portion. Both of the chambers are made able to be communicated with each other by opening and closing a partitioning door 115. As in the case of a combustion furnace that has hitherto appeared, that combustion furnace main body 111 is made of a fire-resistant material.

The smoke collection hood 114 aforementioned, as illustrated in the figure, preferably, is formed into a double-walled structure. Air from the outside is passed through that interior and, by doing so, heat exchange is performed between the air and the exhaust smoke occurring due to the combustion. The air with temperature elevated is supplied into the combustion chamber 113 via a bored pipe 116 equipped to the smoke collection hood 114 to promote the combustion. However, the smoke collection hood 114 can also be formed into a single-walled structure.

On the other hand, the flue contained within the combustion furnace main body 111, for example, a chimney member 117 consists of a coiled pipe. It is disposed in such a fashion as to open at the respective ends to the top and bottom of the combustion furnace main body 111. In the figure, while this coiled pipe is disposed in the vertical direction, it can also be disposed, if desired, in the parallel direction or the oblique direction or in the combined form of the both.

Being heated at a high temperature, the flue 117 needs to be made of a high-temperature resistant material, e.g. metal, alloy, or ceramics having stability at a temperature of 1400° C. or more. As such metal, there are titanium, zirconium, and platinum, as such alloy there is a Ni-based ultrahigh heat resistance alloy, and as such ceramics there are alumina, zirconia, mullite ceramics, silicon carbide, silicon nitride, sialon, etc. Each of these high temperature resistant materials does not need to construct the flue as a whole but needs to construct only the inner side portion contacted with the exhaust smoke.

In the present invention, it is necessary to equip to the flue 117 heating means for heating the exhaust smoke passed through it. While this heating means, preferably, is electrically heating means of a type wherein an electrically heated wire is wound around the coiled pipe or a type wherein the interior of the flue 117 is heated on a dielectric basis, there may be adopted, if desired, a system of heating from the outside by using a combustion burner. A transformer 129 in the figure serves as an electric heating controller in the case of using an electric heating means.

For enhancing the heating efficiency of the exhaust smoke passing through the flue 117, this flue 117 is surrounded and enclosed by a reflective material wall 118, thereby a heating chamber 119 is formed. This reflective material wall 118 serves to cause the radiation to be concentrated onto the flue 117 and thereby to lessen the loss of the supplied power. Although not always necessary, preferably, a partitioning wall 120 is further provided on the outer side of that reflective material wall 118. And, into a gap 121 between the partitioning wall 120 and the reflective material wall 118, there is induced or guided from the upside thereof along the underside of the smoke collection hood 114 the exhaust smoke that has occurred due to the combustion to thereby heat the heating chamber 119 by the use of that heat and to further the rise in the temperature of the flue 117.

The venting holes formed at the top and bottom of said reflective material wall 118 each are formed into a structure wherein the hole diameter is variable, to thereby enable adjusting the temperature of the exhaust smoke located outside the reflective material wall 118 to thereby enable controlling the combustion speed of the exhaust smoke within the flue. In this case, it is also possible to close all of the venting holes and bring the interior into a vacuumed state.

For increasing or decreasing the amount of air and controlling the combustion state of combustion furnace, an on-off value 123 is equipped to an air intake port 122 formed in the top of the smoke collection hood 114.

In the above-described device, since the combustion chamber 113 has an inverse truncated cone-like configuration wall surface, when the combustion flame goes upward along the slant surface, it is gradually heated and has its combustion expanded while, on the other hand, the ash that has occurred slips down that slant surface and simply accumulates onto the bottom surface. In that way, the combustion speed can be increased and the collection of the combustion ash can easily be performed.

Also, a slant surface for promoting the slip-down of the combustion ash such as an inclined wall 124 in FIG. 1 can be separately provided. With respect to that slant surface there can be equipped with a vibrator which applies vibration or shock to the inclined wall, thereby enabling adjusting the amount of combustion ash collected, while a roller for destroying the inflammable materials can also be provided in the combustion chamber 113 to thereby increase the incineration speed.

Further, if desired, a combustion ash take-out port 125 can also be provided at the bottom of the combustion chamber 113. Via that port 125, the combustion ash can also be discharged through the use of a horizontal screw conveyor 126. In this case, for preventing the cool air outside from entering the combustion chamber 113, it is preferable to stop the operation of the horizontal screw conveyor 126 immediately before moving and discharging the combustion ash accumulated and to switch it to a vertical screw conveyor 127. Further, for breaking the combustion ash accumulated into fine pieces, it is also possible to provide a blade portion on the spiral outer-peripheral portion of the screw conveyor or to provide a protruding portion on the inner surface.

In the present invention, for eliminating harmful substances in the exhaust smoke such as dioxin, it is necessary to keep the flue at a temperature that is as high as 1400 to 1600° C. This is realized by interlocking the thermo sensor 128 disposed at a suitable position within the combustion furnace with the heating means for heating the flue to control the temperature within the flue at all times as well as by increasing and decreasing the amount of air taken-in by a regulating valve 131. Although it is preferable to locate said thermo sensor 128 at a position that is as close to the flue as possible, the thermo sensor 128 may be disposed on the wall surface of the combustion furnace main body 111. Adjusting the temperature within the flue and the amount of air taken-in with use of the information from the thermo sensor 128 is more conveniently done if done via a computer.

Incidentally, 130 denotes a waste throw-in port.

INDUSTRIAL APPLICABILITY

According to the present invention, it is possible to incinerate combustible waste without causing exhaustion of harmful substances such as dioxin, by keeping the temperature of the flue at a high temperature and enlarging the length of the flue and thereby highly efficiently processing the exhaust smoke. Further, it is possible to reduce the thermal energy for heating the flue by making effective use of the heat of the exhaust smoke occurring due to the radiation heat and combustion.

Accordingly, the present invention is suitably used as a combustible waste incinerating method and incinerating device therefor.

What is claimed is:

1. A waste incinerating device comprising:

(a) a combustion furnace main body (111) that consists of a heat-resistant cylindrical member the upper part and lower part of which are each shaped in the form of truncated cone, the upper part being defined as a desiccation chamber (112) and the lower part being defined as being a combustion chamber (113);

(b) a chimney member (117) that is disposed within said combustion furnace in the way of its being open with respect to a bottom portion thereof and a top portion thereof and that consists of a high temperature resistant material-made coil-shaped pipe;

(c) a heater that is equipped to said chimney member for raising the temperature of the interior of said chimney member;

(d) a thermo sensor (128) for measuring the temperature within said chimney member; and (e) control means for adjusting the amount of air supplied into said combustion furnace and the temperature of said heater according to the temperature information from said thermo sensor.

2. The waste incinerating device according to claim 1, wherein said chimney member is surrounded and enclosed by a thermo reflection wall member (118).

3. The waste incinerating device according to claim 1, wherein a smoke collection hood (114) is disposed between said combustion furnace main body and said chimney member.

4. The waste incinerating device according to claim 3, wherein said smoke collection hood is constructed into a double-walled structure and an air from the outside is passed into between the two walls thereof to thereby perform heat exchange.

5. The waste incinerating device according to claim 4, wherein a bored pipe (116) for introducing the heated air into said combustion chamber is mounted on said smoke collection hood.

6. The waste incinerating device according to claim 1, wherein said combustion chamber is formed into a hopper-like configuration separate from the combustion furnace main body, whereby, when combustion flame rises along a slant surface, said combustion portion is made easier to heat by degrees and the slip-down of ash generated due to the combustion is made easier for easier collection of said ash.

* * * * *